US009175371B2

(12) United States Patent
Numata et al.

(10) Patent No.: US 9,175,371 B2
(45) Date of Patent: Nov. 3, 2015

(54) STEEL FOR STEEL TUBE WITH EXCELLENT SULFIDE STRESS CRACKING RESISTANCE

(75) Inventors: Mitsuhiro Numata, Kamisu (JP); Tomohiko Omura, Kishiwada (JP); Masayuki Morimoto, Kobe (JP); Toru Takayama, Kobe (JP); Atsushi Soma, Wakayama (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 339 days.

(21) Appl. No.: 13/702,763

(22) PCT Filed: May 25, 2011

(86) PCT No.: PCT/JP2011/002897

§ 371 (c)(1),
(2), (4) Date: Dec. 7, 2012

(87) PCT Pub. No.: WO2011/155140

PCT Pub. Date: Dec. 15, 2011

(65) Prior Publication Data

US 2013/0084205 A1 Apr. 4, 2013

(30) Foreign Application Priority Data

Jun. 8, 2010 (JP) ..... 2010-131276

(51) Int. Cl.

| | |
|---|---|
| ***C22C 38/28*** | (2006.01) |
| ***C22C 38/22*** | (2006.01) |
| ***C22C 38/32*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(Continued)

(52) U.S. Cl.

CPC ..... *C22C 38/32* (2013.01); *C21D 8/0247* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01)

(58) Field of Classification Search

None

See application file for complete search history.

(56) References Cited

U.S. PATENT DOCUMENTS

| | | | | |
|---|---|---|---|---|
| 8,696,834 | B2 * | 4/2014 | Kondo et al. | 148/593 |
| 2006/0231168 | A1 * | 10/2006 | Nakamura et al. | 148/334 |

FOREIGN PATENT DOCUMENTS

| | | |
|---|---|---|
| CN | 1113660 | 12/1995 |
| CN | 1643174 | 7/2005 |

(Continued)

*Primary Examiner* — Deborah Yee

(74) *Attorney, Agent, or Firm* — Clark & Brody

(57) ABSTRACT

The present invention provides a steel which simultaneously satisfies a plurality of characteristics, specifically, a steel for tubes with excellent sulfide stress cracking resistance, including, C: 0.2 to 0.7%; Si: 0.01 to 0.8%; Mn: 0.1 to 1.5%; S: not more than 0.005%; P: not more than 0.03%; Al: 0.0005 to 0.1%; Ti: 0.005 to 0.05%; Ca: 0.0004 to 0.005%; N: not more than 0.007%; Cr: 0.1 to 1.5%; and Mo: 0.2 to 1.0%; the balance being Fe, Mg and impurities, being characterized in that: the content of Mg is not less than 1.0 ppm and not more than 5.0 ppm; and inclusions of not less than 50% of the total number of those in steel have such a morphology that Mg—Al—O-based oxides exist at the central part of the inclusion, Ca—Al-based oxides enclose the Mg—Al—O-based oxides, and Ti-containing-carbonitrides further exist on a periphery of the Ca—Al-based oxides.

2 Claims, 1 Drawing Sheet

(51) Int. Cl.

| | |
|---|---|
| ***C22C 38/24*** | (2006.01) |
| ***C22C 38/26*** | (2006.01) |
| ***C21D 8/02*** | (2006.01) |

(56) References Cited

FOREIGN PATENT DOCUMENTS

| | | |
|---|---|---|
| CN | 1837394 | 9/2006 |
| CN | 1989263 | 6/2007 |
| EP | 2 415 884 | 2/2012 |
| JP | 05-302112 | 11/1993 |
| JP | 2001-342543 | 12/2001 |
| JP | 2003-160838 | 6/2003 |
| JP | 2006-265668 | 10/2006 |
| JP | 2006-283117 | 10/2006 |
| MX | 2011010385 | 1/2012 |
| WO | 03/083152 | 10/2003 |
| WO | 2009/057390 | 5/2009 |

* cited by examiner

STEEL FOR STEEL TUBE WITH EXCELLENT SULFIDE STRESS CRACKING RESISTANCE

TECHNICAL FIELD

The present invention relates to a steel for steel tube with excellent sulfide stress cracking resistance (hereinafter referred also to as "SSC resistance"), which is excellent in cleanliness with fewer harmful coarse inclusions, particularly, a steel for steel tube with excellent SSC resistance, which is suitable for application to steel tubes, and casings, tubing, excavating drill pipes, drill collars and the like for oil well or natural gas well.

BACKGROUND ART

Non-metallic inclusions in steel (hereinafter referred simply to as "inclusions") lead to, as well as causing defective or flaws of steel product, the deterioration of weldability or strength/ductility and further the deterioration of corrosion resistance and, particularly, the larger the size thereof, the more serious such adverse effects. Therefore, a number of methods are developed for reducing the number of or reforming the inclusions, and particularly large-size inclusions.

At the threshold of the development, techniques such as reforming of an oxygen contamination source such as slag, optimization of deoxidation conditions or the like, and moreover removal of inclusions by a secondary refining apparatus such as RH were rigorously developed, and these techniques are being used even now. However, since these techniques cannot meet the required performance of steel product that has been escalated, a control technique of inclusions morphology such as Ca treatment has been developed to respond to such a demand in combination with the existing techniques.

In recent years, the required performance of steel product is further escalated, and a number of new techniques have been proposed to respond to this demand.

For example, Patent Literature 1 discloses a technique for improving bore expandability by use of MgO or MgO-containing inclusions, and Patent Literature 2 discloses a technique for dispersing harmful oxygen as fine MgO by controlling the content of Mg in steel in a specific range.

The present applicant also proposes, in Patent Literature 3, a technique for reducing harmful coarse carbonitride inclusion constituents by generating carbonitrides using a Ca—Al-based oxysulfide inclusion constituent as nuclei.

In this way, the latest techniques utilize the inclusions rather than simple removal or reduction of inclusions that has been performed in the related prior art.

On the other hand, there are various types of inclusions which primarily have constituents such as sulfides, oxysulfides or carbonitrides other than oxides, singly or otherwise in combination. In the past, it was at most one or two of these types of inclusions that hinder efforts to obtain the characteristics required for steel product. For example, surface defects in a cold-rolled steel sheet are principally caused by the coarse oxide type, and the deterioration of the weldability in a structural material such as a steel beam is caused by the sulfide type, so that a desired effect could be attained by taking specific measures against specific inclusion types as described above.

In recent years, however, it has been demanded also to simultaneously satisfy a plurality of characteristics, in addition to the escalated required performance of steel product. For example, a combination of high strength and high corrosion resistance, a combination of high strength and high workability or the like is sought after.

When two kinds of characteristics, let's say, characteristic A and characteristic B, are simultaneously required, for example, two measures against the relevant inclusions such as a measure "a" for satisfying the characteristic A and a measure "b" for satisfying the characteristic B must be taken at the same time according to the conventional point of view.

However, taking a plurality of measures simultaneously may create problems in performance, besides cost and productivity.

For example, although the sulfides can be reduced by reducing the content of S in steel, the decrease in content of S can lead to increase in the number of the oxide type inclusions since the interfacial tension between molten iron and inclusions reduces according to the decrease in content of S to thereby deteriorate the floatation separability of inclusions. Further, the reduction in content of S in steel leads to a change in content of N in steel which results from an increased rate of denitrification or nitride absorption of molten iron, and as a result, the number of nitrides can likely vary.

Namely, the decrease of a specific type of inclusions can create problems such as the increase of other types of inclusions and the deterioration of inclusions controllability.

Further, when a plurality of characteristics are simultaneously required with particularly high performance, what matters is not the number of specific types of inclusions such as oxides or sulfides that affects other characteristics, but the total number of two or more types of inclusions such as oxides, sulfides, oxysulfides and carbonitrides. For example, even if MnS is reformed with Ca or the like to be made harmless for the purpose of improving the corrosion resistance of steel product, Ca-based inclusions after the reformation may degrade the surface quality of the steel product. In such a case, it is necessary to reduce the total number of inclusions after the reformation, in addition to render MnS harmless, and the necessary measures therefor are further complicated.

In this way, when a plurality of different characteristics are to be satisfied at a high level, the measures against inclusions are complicated to end up in deteriorating the stability of quality, while causing the productivity and costs of product to be deteriorated. Since this deterioration of stability causes the reduction of product yield, further efforts for commercial industrial production are needed while the supply of the product is possible.

CITATION LIST

Patent Literature

Patent Literature 1: Japanese Patent Application Publication No. 2001-342543

Patent Literature 2: Japanese Patent Application Publication No. 5-302112

Patent Literature 3: WO 03/083152

Patent Literature 4: Japanese Patent Application Publication No. 2003-160838

SUMMARY OF INVENTION

Technical Problem

As described above, it is difficult for the related prior art to stably satisfy a plurality of performances or characteristics at the same time. From the viewpoint of this problem, the present invention has an object to provide a steel for steel tubes with excellent SSC resistance, which can simultaneously satisfy a plurality of characteristics.

Solution to Problem

To simultaneously secure a plurality of characteristics, as described above, it is necessary to reduce the number of coarse inclusions while controlling a specific type of inclusions which affects a specific characteristic after settling the composition of steel product in a predetermined range. As a result of studies and investigations on the composition of steel and the composition of inclusions from this point of view with respect to the steel for steel tubes, the present inventors found that the steel for steel tubes having predetermined strength and toughness as well as excellent SSC resistance can be obtained by setting the content of Mg in a specific range, as described later, after settling the composition of steel product in a predetermined range, so as to control the morphology of inclusions contained in the steel product, thereby reducing the number of coarse inclusions. The present invention is achieved based on this knowledge, and the gist of the invention consists in the steel for steel tubes with excellent SSC resistance described in the following (1) and (2).

(1) A steel for steel tubes with excellent SSC resistance, including, by mass %: C: 0.2 to 0.7%; Si: 0.01 to 0.8%; Mn: 0.1 to 1.5%; S: not more than 0.005%; P: not more than 0.03%; Al: 0.0005 to 0.1%; Ti: 0.005 to 0.05%; Ca: 0.0004 to 0.005%; N: not more than 0.007%; Cr: 0.1 to 1.5%; and Mo: 0.2 to 1.0%; the balance being Fe, Mg and impurities, being characterized in that: the content of Mg in the steel is not less than 1.0 ppm and not more than 5.0 ppm; and non-metallic inclusions of not less than 50% of the total number of those in steel each having the maximum bulk size of not less than 1 μm and comprising two or more elements of Ca, Al, Mg, Ti and Nb and two or more elements of O, S and N have such a morphology that Mg—Al—O-based oxides exist at the central part of the inclusion, Ca—Al-based oxides and/or Ca—Al-based oxysulfides enclose the Mg—Al—O-based oxides, and Ti-containing-carbonitrides or -carbides further exist on a complete or partial periphery of the Ca—Al-based oxides and/or Ca—Al-based oxysulfides (hereinafter referred to as "first inventive steel").

(2) A steel for steel tubes with excellent SSC resistance, including, by mass %: C: 0.2 to 0.7%; Si: 0.01 to 0.8%; Mn: 0.1 to 1.5%; S: not more than 0.005%; P: not more than 0.03%; Al: 0.0005 to 0.1%; Ti: 0.005 to 0.05%; Ca: 0.0004 to 0.005%; N: not more than 0.007%; Cr: 0.1 to 1.5%; Mo: 0.2 to 1.0%; and one or more of Nb: 0.005 to 0.1%, Zr: 0.005 to 0.1%, V: 0.005 to 0.5% and B: 0.0003 to 0.005%; the balance being Fe, Mg and impurities, being characterized in that: the content of Mg in the steel is not less than 1.0 ppm and not more than 5.0 ppm; and non-metallic inclusions of not less than 50% of the total number of those in steel each having the maximum bulk size of not less than 1 μm and comprising two or more elements of Ca, Al, Mg, Ti and Nb and two or more elements of O, S and N have such a morphology that Mg—Al—O-based oxides exist at the central part of the inclusion, Ca—Al-based oxides and/or Ca—Al-based oxysulfides enclose the Mg—Al—O-based oxides, and Ti-containing-carbonitrides or -carbides further exist on a complete or partial periphery of the Ca—Al-based oxides and/or Ca—Al-based oxysulfides (hereinafter referred to as "second inventive steel").

In the following, with respect to component compositions of steel and slag, "mass %" and "mass ppm" will be simply referred to as "%" and "ppm".

In the descriptions herein and the claims, the composition of steel is used in the sense of "content in steel tube product" unless otherwise noted.

Various types of inclusions recited in the claims are defined as follows.

"Non-metallic inclusions in steel comprising two or more elements of Ca, Al, Mg, Ti and Nb and two or more elements of O, S and N": Among coarse inclusions each having the maximum bulk size of not less than 1 μm in steel tube products, defined is the one in which each content of at least two elements selected from Ca, Al, Mg, Ti and Nb, and each content of at least two elements selected from O, S and N are 5% or more, respectively, and the total content of Ca, Al, Mg, Ti, Nb, O, S and N is not less than 80%. In addition, the inclusion defined here is an aggregation of plural non-metallic inclusion constituents (inclusion phases): "Mg—Al—O-based oxides", "Ca—Al-based oxides" and/or "Ca—Al-based oxysulfides" and "Ti-containing-carbonitrides or -carbides" which are defined below.

"Mg—Al—O-based oxides": defined is a constituent of the abovementioned aggregate in which each content of Mg, Al, O is 2.5% or more, and the total content of Mg, Al and O in the constituent is not less than 8%.

"Ca—Al-based oxides": defined is a constituent of the abovementioned aggregate in which each content of Ca, Al and O is 3.0% or more, and the total content of Ca, Al and O in the constituent is not less than 15%.

"Ca—Al-based oxysulfides": defined is a constituent of the abovementioned aggregate in which each content of Ca, Al, O and S is 2.0% or more, and the total content of Ca, Al, O and S in the constituent is not less than 15%.

"Ti-containing-carbonitrides or -carbides": defined is a constituent of the abovementioned aggregate in which each content of Ti, N and C is 1.2% or more, and the total content of Ti, N and C in the constituent is not less than 5%.

Advantageous Effects of Invention

The steel for steel tubes according to the present invention is excellent in cleanliness with fewer harmful coarse inclusions, usable as a steel material for steel tubes, and casings, tubing, excavating drill pipes, drill collars, etc. for oil well or natural gas well, excellent particularly in SSC resistance while having predetermined strength and toughness, and easy to be produced and controlled.

DESCRIPTION OF EMBODIMENTS

Figure 1:
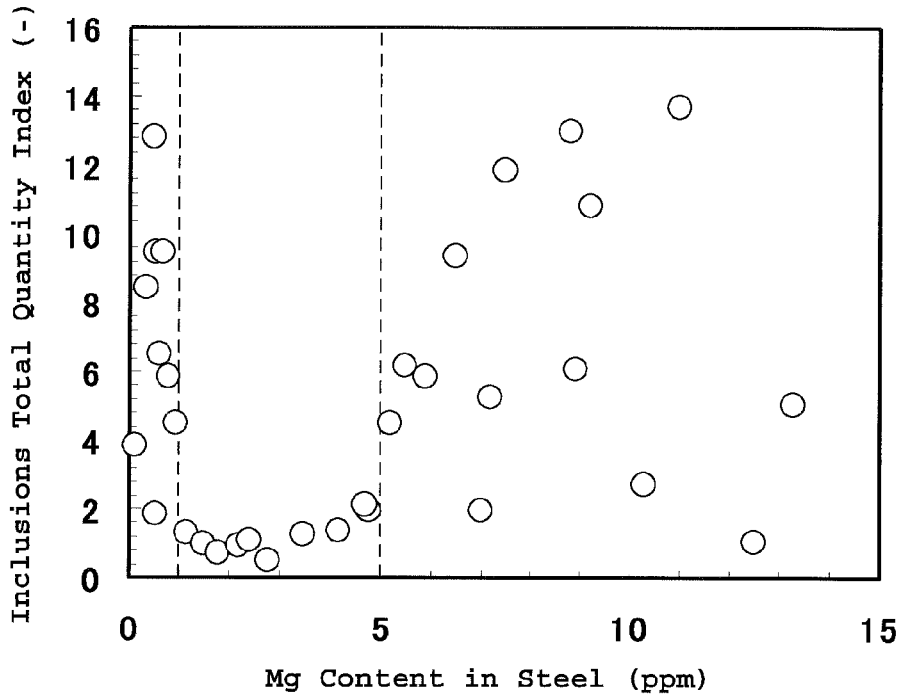
FIG. 1 is a graph showing a relation between a Mg content in steel and an inclusion total quantity index.

The steel for steel tubes of the present invention will be then described in detail with respect to the reasons of specifying the steel of the present invention as described above and preferred embodiments for producing the steel of the present invention.

1. Ranges of Chemical Composition of the Steel of the Invention, and Reasons for Limitation 1-1. Basic Elements C: 0.2 to 0.7%

C is an important element for securing the strength of a steel tube, and its content needs to be not less than 0.2%. However, an excessively high content of C not only leads to the saturation of the effect, but also causes a change in generated morphology of non-metallic inclusions to thereby deteriorate the toughness of steel and lead to a high susceptibility to quenching crack. Therefore, the upper limit of the content of C is set to 0.7%. A preferable C content is 0.22 to 0.65%; more preferably 0.24 to 0.40%.

Si: 0.01 to 0.8%

Si is added for the purpose of deoxidizing steel or improving the strength of steel. When the content of Si is below 0.01%, the effect of deoxidizing the steel or improving the strength is not exerted. On the other hand, a content of Si exceeding 0.8% causes reduction in activity of Ca or S, which affects the morphology of inclusions. Therefore, the content of Si is set in the range of 0.01 to 0.8%.

Mn: 0.1 to 1.5%

Mn is added with a content of not less than 0.1% for the purpose of enhancing the strength of steel through improvement in quenching-hardenability of the steel. However, since an excessively high content may cause deterioration in toughness, the upper limit of the content of Mn is set to 1.5%. The Mn content is preferably 0.20 to 1.40%, more preferably 0.25 to 0.80%.

S: Not more than 0.005%

S is an impurity which forms sulfide-based inclusions, and when the content of S is increased, the deterioration in toughness or corrosion resistance of steel becomes serious. Therefore, the content of S is set to not more than 0.005%. A lower S in content is more desirable.

P: Not more than 0.03%

P is an element included in steel as an impurity, and causes deterioration in toughness or corrosion resistance of steel. Therefore, the upper limit of the content of P is set to 0.03%. The P content is preferably at most 0.02%, more preferably 0.012%. It is desirable that the content of P is as least as possible.

Al: 0.0005 to 0.1%

Al is an element to be added for deoxidizing molten steel. When the content of Al is less than 0.0005%, coarse composite oxides of Al—Si type, Al—Ti type, Al—Ti—Si type and the like can be generated due to insufficient deoxidation. On the other hand, an excessively increased content of Al only leads to saturation of the effect, ending up in the increase of useless solid-soluble Al. Therefore, the upper limit of the content of Al is set to 0.1%.

1-2. Additive Elements for Improving SSC Resistance

Further, the SSC resistance of steel can be improved by setting each content of Ti, Ca, N, Cr and Mo to the range described below.

Ti: 0.005 to 0.05%

Ti has the effect of improving the strength of steel by action such as grain refining or precipitation hardening. Further, when B is added to improve the quenching-hardenability of steel, Ti can inhibit nitridation of B so that the effect of improving the quenching-hardenability can be exerted. To secure these effects, the content of Ti must be not less than 0.005%. However, since an excessively high content of Ti increases carbide-based precipitates to deteriorate the toughness of steel, the upper limit of the content of Ti is set to 0.05%. A preferable Ti content is 0.008 to 0.035%.

Ca: 0.0004 to 0.005%

Ca is an important element which reforms sulfides and oxides at the same time to improve the SSC resistance of steel. To secure this effect, the content of Ca must be not less than 0.0004%. However, since an excessively high content of Ca causes coarsening of inclusions or deterioration in corrosion resistance of steel, the upper limit of the content of Ca is set to 0.005%.

N: Not more than 0.007%

N is an impurity element which tends to be mixed to raw materials or mixed during melting processes. An increased content of N leads to deterioration in toughness, corrosion resistance and SSC resistance of steel, inhibition of the effect of improving the quenching-hardenability by addition of B, or the like. Therefore, a lower N in content is more desirable. Although an element such as Ti which forms nitrides is added to suppress this adverse effect of N, this follows generation of nitride-based inclusions. Accordingly, since an excessively high content of N disables the control of inclusions, the upper limit of the content of N is set to 0.007%.

Cr: 0.1 to 1.5%

Cr has the effect of improving the corrosion resistance of steel, and further has the effect of improving the SSC resistance of steel since it improves the quenching-hardenability to improve the strength of steel and also enhances the resistance to softening by tempering of steel to thereby enable high-temperature tempering. To secure these effects, the content of Cr must be not less than 0.1%. However, since an excessively increased content of Cr only leads to saturation of the effect of improving tempering softening resistance, and can cause deterioration in toughness of steel, the upper limit of the content of Cr is set to 1.5%. A preferable Cr content is 0.5 to 1.2%.

Mo: 0.2 to 1.0%

Mo improves the quenching-hardenability to improve the strength of steel, and also improves the SSC resistance of steel since it enhances the resistance to softening by tempering to enable high-temperature tempering. To secure these effects, the content of Mo must be not less than 0.2%. However, since an excessively increased content of Mo only leads to saturation of the effect of improving the resistance to softening by tempering, and can cause deterioration in toughness of steel, the upper limit of the content of Mo is set to 1.0%. A preferable Mo content is 0.25 to 0.85%.

1-3. Additive Elements for Further Improving SSC Resistance

The SSC resistance of steel can be further improved by controlling, besides the above, the contents of Nb, Zr, V and B to the following ranges.

Nb: 0.005 to 0.1%, Zr: 0.005 to 0.1%

Nb and/or Zr may not need to be added. However, if added, these elements exert an effect such as grain refining or precipitation hardening to effectively improve the strength of steel. Such an effect cannot be secured with a content of less than 0.005% of each element, and when the content of each element exceeds 0.1%, the toughness of steel is deteriorated. Therefore, if Nb and/or Zr is added, the content of each element is preferably set to 0.005 to 0.1%. More preferably the content of each element is set in the range of 0.008 to 0.05%.

V: 0.005 to 0.5%

V may not need to be added. However, V has effects such as precipitation hardening, improvement in quenching-hardenability, and increase in resistance to softening by tempering, and if added, the effect of improving the strength and the SSC resistance can be expected. To secure this effect, the content of V is preferably set to not less than 0.005%. However, since an excessively increased content of V causes deterioration in toughness or corrosion resistance of steel, the upper limit of the content of V is preferably set to 0.5%. More preferably the V content is set in the range of 0.01 to 0.25%.

B: 0.0003 to 0.005%

B may not need to be added. However, a slight addition of B has the effect of improving the quenching-hardenability of steel. When the content of B is below 0.0003%, such an effect cannot be obtained, and when the content exceeds 0.005%, the toughness of steel is deteriorated. Therefore, if B is added, the content is preferably set to 0.0003 to 0.005%.

1-4. Addition of Mg 1-4-1. Relation Between Mg Content in Steel and Total Number of Inclusions In the present invention, the Mg content in the steel is set in the range of 1.0 to 5.0 ppm. The Mg content is preferably 1.2 to 4.8 ppm, more preferably 1.4 to 4.6 ppm. Next, Mg will be described in detail. As described above, a plurality of characteristics can be simultaneously secured by simultaneously controlling two or more types of inclusions in order to control a plurality of elements and by taking remedies to prevent the total number of the inclusions from increasing. Further, it is desirable that factors to be controlled or managed are as least as possible.

From such a point of view, the relation between the inclusion morphology, the number of inclusions and steel compositions were investigated in detail. Namely, 300 kg of each molten steel with steel compositions variously varies within the above-mentioned ranges was solidified in a mold, a test piece was cut from the resulting steel ingot, and observed within a 10 mm×10 mm field of view at a magnification of 1000× by use of a scanning electron microscope to measure the number of inclusions each being not less than 1 μm in size. The total of all the number of oxides, oxysulfides and carbonitrides was defined as "the total number of inclusions". The evaluation was performed using an inclusion total quantity index with 1 indicating the total number of inclusions in a sample having a Mg content of 1.5 ppm in steel. The Mg content in steel was obtained by dissolving machining swarf sampled from each steel ingot with nitric acid, and diluting the resulting solution to a concentration of 1/10, followed by quantitative determination by ICP-MS (Inductively Coupled Plasma Mass Spectrometry).

FIG. 1 is a graph showing a relation between a Mg content in steel and an inclusion total quantity index. As a result of the above-mentioned examination, a general tendency such that the lower the S content, the less the sulfide inclusions, and the higher the O content, the more the oxide inclusions was obtained, and results shown in FIG. 1 were also obtained.

On the surface, FIG. 1 appears to indicate that it is difficult to organize the total number of inclusions of interest in the present invention only by a Mg content in steel, and the contents of elements such as O and S also contribute to the total number of inclusions as described above. However, paying attention to the results on the low Mg content side in FIG. 1, it is found that the total number of inclusions is stably reduced when the Mg content in steel is not less than 1.0 ppm (0.00010%) and not more than 5.0 ppm (0.00050%). On the other hand, when the Mg content in steel is below 1.0 ppm or beyond 5.0 ppm, cases with the total number of inclusions being big are also obtained while there are many cases with the total number of inclusions being small.

Namely, it is found that the total number of the targeted inclusions of 1 μm or more in size may be reduced by controlling the content of Mg when the Mg content in steel is not less than 1.0 ppm and not more than 5.0 ppm; however, when the Mg content in steel is below 1.0 ppm or beyond 5.0 ppm, the control of other elements in addition to the Mg content is needed even under the same condition.

1-4-2. Inclusion Morphology

Further, the inclusion morphology was observed in detail, with respect to cases in which the Mg content in steel is not less than 1.0 ppm and not more than 5.0 ppm in FIG. 1 and the total number of inclusions is small. As a result, an average of 78.3% (67.3 to 95.3%) of the number of the targeted inclusions of not less than 1 μm in size has a structure illustrated in FIG. 2 as the inclusion morphology. The remaining 21.7% of inclusions were oxides free of carbonitrides or inclusions only composed of oxysulfides or carbonitrides.

Figure 2:
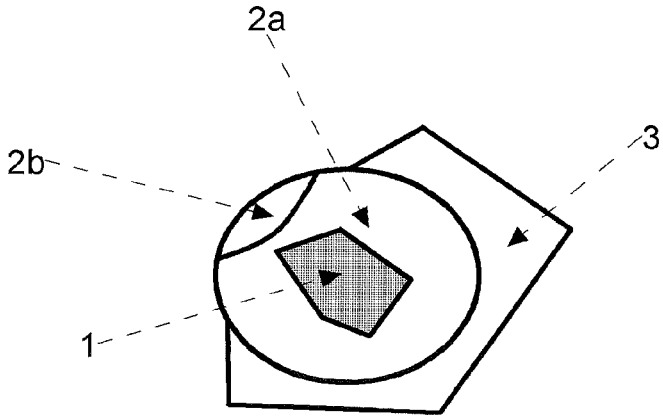
FIG. 2 is a schematic view illustrating a morphology of an inclusion of not less than 1 μm in size which exists in steel when a Mg content in steel is not less than 1.0 ppm and not more than 5.0 ppm.

FIG. 2 is a schematic view illustrating a morphology of an inclusion of not less than 1 μm in size which exists in steel when a Mg content in steel is not less than 1.0 ppm and not more than 5.0 ppm.

As shown in FIG. 2, this inclusion has a morphology in which Ti-containing-carbonitrides or -carbides 3 exists in a periphery part of Ca—Al-based oxides 2*a* and Ca—Al-based oxysulfides 2*b*. Since this inclusion alone enables the control of O, S, C and N, a treatment for controlling inclusions for each of impurity elements is not necessary. The present applicant made clear this morphology of inclusion in Patent Literature 3 described above.

However, it has been clarified now that Mg—Al—O-based oxides 1 exist at the central part of the inclusion so as to be enclosed by Ca—Al-based oxides 2*a* and Ca—Al-based oxysulfides 2*b*. It has been ascertained that when the inclusion morphology shown in FIG. 2 emerges, the total number of inclusions is reduced. This inclusion may have a morphology in which the Ti-containing-carbonitrides or -carbides 3 exist on a complete periphery of the Ca—Al-based oxides 2*a* and the Ca—Al-based oxysulfides 2*b*. The inclusion may solely include either of the Ca—Al-based oxides 2*a* or the Ca—Al-based oxysulfides 2*b*.

1-4-3. Mechanism of Forming Inclusions and Mechanism of Reducing Total Number of Inclusions The mechanisms related to the above-mentioned inclusion morphology can be explained as follows.

When Mg exists in steel, Mg starts deoxidation reaction prior to Al and Ca since it is a strong deoxidizing element. The Mg—Al—O-based oxides 1 are generated thereby prior to the Ca—Al-based oxides 2*a* and the Ca—Al-based oxysulfides 2*b*. Since Mg starts the deoxidation reaction even at lower supersaturation than those of the other elements due to its deoxidizing power, inclusions become small in size. Namely, when the content of Mg is within a predetermined range, fine Mg—Al—O-based oxides 1 are preferentially generated. Thereafter, using these fine Mg—Al—O-based oxides 1 as generation nuclei, Ca—Al-based oxides 2*a* and the Ca—Al-based oxysulfides 2*b* are generated on their surfaces, and again using these as generation nuclei, Ti-containing-carbonitrides or -carbides 3 are further generated on their surfaces during solidification. As a result, the inclusion morphology as shown in FIG. 2 is completed. At this time, since the formation of the inclusion is originated from fine Mg—Al—O-based oxides 1, the resulting final inclusions are also fine, and coarse inclusions are consequently reduced.

However, when the Mg content in steel is lower than 1.0 ppm, the final inclusions can be enlarged since the fine Mg—Al—O-based oxides 1 as origins are not generated. On the other hand, when the Mg content in steel is higher than 5.0 ppm, the Mg—Al—O-based oxides 1 can grow to be large since the Mg deoxidation reaction excessively proceeds, resulting in enlarged final inclusions.

Namely, it is found that the inclusion morphology is changed as a result of change in generation process of the inclusions by the control of the Mg content in steel, whereby coarse inclusions can be reduced.

2. Control Methods of Mg Content in Steel and Inclusions 2-1. Control Method of Mg Content in Steel Control methods of Mg content in steel and inclusions will be then described. Firstly, the control method of Mg content in steel is described.

A first method is to directly add Mg to molten steel. In this method, metal Mg or Mg alloy alone or a mixture of Mg or Mg alloy with a compound such as CaO or MgO is added to molten steel.

This addition may be carried out by blowing Mg into molten steel or by use of an iron-coated wire, similarly to the after-mentioned case of Ca. The addition amount (per ton of molten steel) is desirably set to 0.05 to 0.2 kg/ton in terms of pure Mg content. When the addition amount is below 0.05 kg/ton, the Mg content in steel cannot be increased, and the addition by the amount higher than 0.2 kg/ton can lead to an increased Mg content in steel which exceeds 5.0 ppm.

The addition of Mg is performed desirably at a terminal stage of secondary refining, and further desirably just before casting. This is to minimize the change in Mg content in steel because Mg vaporizes from the molten steel. The addition just before casting can be performed, for example, by addition into molten steel within the tundish of a continuous casting machine A second method is to indirectly supply Mg to molten steel by use of slag and refractory. Since the refractory or slag generally contains MgO, this MgO is used as a Mg source to the molten steel. When the refractory contains no MgO, only the slag is used as a Mg source.

Based on the principle that Al, Ca and the like in molten steel exhibit the reaction of reduction of the MgO included in the refractory or slag, the reduced Mg is supplied to the molten steel. This reduction reaction extremely gently proceeds since Mg has strong deoxidizing power and MgO is stable. Therefore, the second method is suitable to control the content of a small amount of Mg in molten steel. Specifically, the second method is carried out in the following manner.

In general, the refractory composition is controlled so that the content of MgO in the slag is not less than 5% since the refractory composition is constant. Although the MgO in the slag is increased also by the reaction of the slag with the refractory, MgO may be added to the slag if the MgO in the slag is insufficient. This addition treatment of MgO is performed desirably at an early stage of steelmaking process such as during pouring from a converter to a ladle or before starting the secondary refining, because the reaction of MgO with molten steel is slow as described above.

When a deoxidizing element such as Al is then put into the molten steel, the reaction of MgO with the molten steel is started to gradually increase the content of Mg in the molten steel. Since the increasing rate of Mg content at this time depends on the content of the deoxidizing element such as Al, Ca or the like or the slag composition in the molten steel, but is constant if the content of the deoxidizing element or the slag composition is constant, the final content of Mg in the molten steel depends on only the treatment time. Therefore, a relation between the addition amount of the deoxidizing element and the treatment time is acquired from temporal change records of Mg content in the molten steel in the steelmaking process, whereby the content of Mg in the molten steel can be controlled based on the acquired relation. This method is advantageous in terms of both time and cost since Mg addition treatment is unnecessary, and strict management of the treatment time, the addition of the deoxidizing element and the slag composition suffice as the control.

Of the above-mentioned two methods for controlling the Mg content in steel, the second method is preferred when the controls of Mg content in steel and inclusions are simultaneously performed.

Since Mg-based inclusion constituents are used as nuclei of relevant inclusions in the steel of the present invention, it is important that the inclusion constituents that form the nuclei are uniformly and homogeneously distributed in the steel. In order to have the inclusion constituents uniformly and homogeneously in steel, it is necessary to equilibrate the reaction between molten steel and inclusion constituent. Although the equilibration of the reaction can be attained by extending the treatment time, this is not viable commercially. Further, when the deoxidizing element such as metal Mg is added to molten steel by adopting the first method, attaining uniform and homogeneous inclusion constituents can be impaired since various types of inclusions are formed due to the distribution of concentration which occurs until the added Mg is uniformly mixed to the molten steel.

On the other hand, since the molten steel-slag reaction is used, the second method does not cause such distribution of concentration which should occur due to the delay of uniform mixing of Mg. Further, since the slag is the same as Mg—Al—O-based oxides that form nuclei, the relevant inclusion constituents can be prevented from being heterogeneous by using the equilibration in molten steel-slag-inclusions/constituents reaction.

2-2. Specific Factors in Second Method

Specific Factors in the second method include slag factors and deoxidation factors as described below.

2-2-1. Slag Factors

Firstly, the slag factors in the second method will be described. The slag to be used is required to have a composition such that the content of CaO is not less than 40%, the content of MgO is not less than 5%, and a total content of Fe oxides and Mn oxides is not more than 3% in the slag. Further, by controlling the content of MgO in the slag to not more than 15% and the content of CaO in the slag to not more than 70%, the accuracy of the control of Mg content in steel is improved.

When the content of MgO in the slag is below 5%, the content of Mg in molten steel cannot be increased, and when it is higher than 15%, the controllability of the Mg content in steel is deteriorated since the fluidity of the slag is deteriorated to reduce the reaction rate of the molten steel-slag reaction.

When the content of CaO in the slag is below 40%, the MgO in the slag cannot be subjected to reducing reaction to be supplied to the molten steel since the oxygen activity at the slag-metal interface cannot be sufficiently decreased. When the content of CaO in the slag is higher than 70%, the controllability of Mg content in steel is deteriorated due to deterioration of the fluidity of the slag.

When the total content of Fe oxides and Mn oxides in the slag is higher than 3%, the MgO in the slag cannot be subjected to reducing reaction to be supplied to molten steel since the oxygen activity at the slag-metal interface cannot be sufficiently decreased.

Further, the amount of slag in use (per ton of molten steel) is desirably set to not less than 10 kg/ton and not more than 20 kg/ton. When the amount of slag is below 10 kg/ton, the absolute amount of MgO is insufficient, and when the amount is larger than 20 kg/ton, the time required for equalizing the slag composition is extended.

2-2-2. Deoxidation Factors

Next, deoxidation factors in the second method are described. The relevant inclusions can be further accurately controlled, in addition to the Mg content in molten steel, by satisfying the deoxidation factors of the molten steel after satisfying the above-mentioned slag factors. The deoxidizing elements used in controlling are Al and Ca.

2-2-2-1. Factors for Al

Firstly, factors for Al are described. In general, since deoxidation is sufficiently performed when the content of Al in molten steel is not less than 0.01%, refining is usually performed with a content of Al in molten steel in the range of about 0.01 to 0.05%. Although Mg can be controlled if the content of Al in the molten steel is continuously controlled to a narrow range within such a content range, this causes extension of the refining time and deterioration of the accuracy in the inclusions morphology control. Therefore, as a method to avoid them, it can be adopted to enhance the content of Al in the molten steel to 0.05% or more for not less than 1 minute in the secondary refining such as RH.

It is extremely effective for reduction of MgO in the slag and decrease of Fe oxide and Mn oxide in the slag to enhance the content of Al in the molten steel even in a time as short as 1 minute, and the control accuracy of Mg and inclusions in steel is consequently improved.

2-2-2-2. Factors for Ca

Finally, factors for Ca are described. Ca is an important element which forms inclusions, similarly to Mg, and the following method is effectively used to cause Mg-based inclusions to be nuclei.

For causing the Mg-based inclusions to be nuclei, it goes without saying that the addition of Ca must be performed after the Mg content in molten steel is sufficiently stabilized. However, it is more necessary to inhibit Ca from promoting the reaction of reducing the MgO in the slag by its reaction with the slag, and further to inhibit excessive progress of the reaction of Ca with the Mg-based inclusions lest even the nuclei of the inclusions should be reduced by Ca.

To satisfy this factors, it is necessary to add Ca in the absence of the slag, and stop the reaction by rapidly casting and solidifying as soon as Ca is added. For satisfying these conditions, it is most desirable to perform the addition of Ca within the tundish of the continuous casting machine.

The addition amount of Ca (per ton of molten steel) must be not less than 0.02 kg/ton and not more than 0.05 kg/ton. This addition amount of Ca is extremely low, compared with a general addition amount of Ca. The reason is that Ca can reduce the nuclei if the addition amount of Ca is more than 0.05 kg/ton. On the other hand, when the addition amount of Ca is below 0.02 kg/ton, sufficient Ca-based inclusions for enclosing the nuclei are not formed.

As described above, to control relevant non-metal inclusions in steel intended by the present intention, which has an Mg content in steel of not less than 1.0 ppm and not more than 5.0 ppm, and is composed of two or more elements of Ca, Al, Mg, Ti and Nb and two or more elements of O, S and N into a morphology in which an Mg—Al—O-based oxide exists at the central part of the inclusion, a Ca—Al-based oxide or a Ca—Al-based oxysulfide encloses the Mg—Al—O-based oxide, and a Ti-containing-carbonitrides or -carbides further exists on a complete or partial periphery of the Ca—Al-based oxide or Ca—Al-based oxysulfide, it is important to temporarily increase the content of Al in molten steel to 0.05% or more after controlling the slag composition into a proper range, and further add not less than 0.02 kg/ton and not more than 0.05 kg/ton of Ca within the tundish of the continuous casing machine.

3. Preferable Production Conditions for Attaining Inclusion Morphology

Preferable steel production conditions for achieving such an inclusion morphology will be described with examples of general production processes such as converter, secondary refining, and continuous casting.

3-1. Control of Sulfides

Firstly, the control of sulfides will be described. When the content of S in steel is lowered, the amount of formed sulfides or oxysulfides is reduced, and inclusions thereof become smaller in size and fewer in number. For having smaller and fewer inclusions, the content of S in steel is preferably not more than 0.002%, and further preferably not more than 0.001%.

To attain such an S content in steel, desulfurization treatment in secondary refining may be needed in addition to desulfurization treatment in hot pig iron preliminary treatment. The desulfurization in secondary refining is performed by blowing gas to molten steel after producing a slag having desulfurizing capability on the molten steel, or by blowing a desulfurizing flux into molten steel or spraying it onto the surface of molten steel. In the treatment using the desulfurizing flux, each of a method of performing the treatment under the atmosphere and a method of performing the treatment under reduced pressure by use of RH or the like can be applied.

3-2. Control of Oxides

With respect to oxides, also, the effect of having fewer inclusions can be developed by lowering the content of O in steel, similarly to the control of sulfide inclusions by lowering the content of S in steel. To secure this effect, the content of O in steel is preferably not more than 0.0015%, and further preferably not more than 0.0010%.

For lowering the content of O in steel, two methods represented by the intensified deoxidation and the inclusions removal in molten steel, are effective.

Although it is effective to set the content of Al to not less than 0.01% for the intensified deoxidation, the deoxidation may be performed further by the above-mentioned slag refining method of setting the content of CaO in slag to not less than 40%, a method of setting the total content of Fe oxides and Mn oxides in slag to not more than 3%, or the like.

The removal of inclusions may be performed by blowing inert gas into molten steel, by circulating molten steel by use of a vacuum treatment device such as RH, or the like.

The addition of Ca may be performed by blowing metal Ca or Ca alloy or a material containing them into molten steel, by performing the addition by use of iron-coated wire, or the like, and any other methods are also applicable. The addition of Ca is desirably performed after the desulfurization in secondary refining. This is to inhibit the reaction of Ca with S. The content of Ca is preferably not more than 0.002%, and further preferably not more than 0.0012%. The reason is that an increased content of Ca intensifies the deoxidation effect but leads to activation of forming CaS or the like.

3-3. Control of Carbonitrides

Although the amount of formed carbonitrides can be reduced by lowering the content of C or Ti, the contents of these elements cannot be lowered since they contribute to improve the strength of base metal as described above. Therefore, lowering the content of N is effective for the control of carbonitrides. In particular, the content of N is preferably not more than 0.004%, and further preferably not more than 0.003%.

The control technique characterized by a combination of Ca and Ti, which is proposed in Patent Literature 4 by the present applicant, can be used in combination.

3-4. Other Preferable Conditions

As mentioned above, the content of O in steel is desirably not more than 0.0015%, and further desirably not more than 0.0010%. The inclusion morphology shown in FIG. 2 can be easily obtained with an O content in steel of not more than 0.0015%, and substantially all inclusions show the morphology shown in the same figure with not more than 0.0010%.

Lanthanoid such as La, Ce or Nd can be added to the steel of the present invention. These elements have the effect of stabilizing the Mg content in addition to reducing the activities of O and S. The desirable content of lanthanoid is not less than 0.001% and not more than 0.05% in total. The effect is insufficient with a content below 0.001%, and the inclusions intended by the present invention cannot be obtained with a content beyond 0.05% since the inclusions are changed to a lanthanoid-based oxysulfides such as $Ce_2O_2S$.

Nos. 7 to 9 are inventive examples satisfying the limitations of the second inventive steel with preferred production conditions. Test Nos. 10 to 15 are comparative examples which does not satisfy any limitations of the first inventive steel and the second inventive steel.

TABLE 1

| Test No. | Classification | Chemical compositions (mass %, the balance being Fe and impurities) | | | | | | | | | | | | | | | |
|---|---|---|---|---|---|---|---|---|---|---|---|---|---|---|---|---|---|
| | | C | Si | Mn | S | P | Al | Ti | Ca | N | Cr | Mo | Nb | Zr | V | B | Mg |
| 1 | Inventive Example | 0.27 | 0.27 | 0.41 | 0.0015 | 0.004 | 0.031 | 0.014 | 0.0004 | 0.0049 | 0.51 | 0.71 | — | — | — | — | 0.00012 |
| 2 | Inventive Example | 0.34 | 0.11 | 0.42 | 0.0007 | 0.004 | 0.032 | 0.013 | 0.0008 | 0.0045 | 0.51 | 0.69 | — | — | — | — | 0.00035 |
| 3 | Inventive Example | 0.28 | 0.28 | 0.41 | 0.0013 | 0.003 | 0.035 | 0.014 | 0.0025 | 0.0032 | 1.03 | 0.72 | — | — | — | — | 0.00048 |
| 4 | Inventive Example | 0.29 | 0.31 | 0.4 | 0.0004 | 0.005 | 0.031 | 0.015 | 0.0015 | 0.0049 | 0.98 | 0.73 | 0.005 | 0.005 | — | 0.0015 | 0.00013 |
| 5 | Inventive Example | 0.31 | 0.28 | 0.41 | 0.0005 | 0.006 | 0.045 | 0.014 | 0.0013 | 0.0048 | 0.53 | 0.71 | 0.011 | 0.015 | — | 0.0013 | 0.00027 |
| 6 | Inventive Example | 0.28 | 0.29 | 0.42 | 0.0009 | 0.005 | 0.037 | 0.013 | 0.0009 | 0.0044 | 0.51 | 0.72 | 0.023 | — | 0.05 | 0.0009 | 0.0005 |
| 7 | Inventive Example | 0.26 | 0.31 | 0.41 | 0.0011 | 0.004 | 0.047 | 0.015 | 0.0032 | 0.0043 | 1.01 | 0.72 | 0.018 | — | 0.22 | 0.0003 | 0.00011 |
| 8 | Inventive Example | 0.29 | 0.28 | 0.41 | 0.0003 | 0.005 | 0.042 | 0.016 | 0.0011 | 0.0041 | 1.03 | 0.71 | 0.032 | — | 0.07 | 0.0018 | 0.00033 |
| 9 | Inventive Example | 0.3 | 0.25 | 0.42 | 0.0008 | 0.005 | 0.044 | 0.017 | 0.0009 | 0.0035 | 0.51 | 0.73 | 0.021 | — | — | 0.0012 | 0.00049 |
| 10 | Comparative Example | 0.27 | 0.27 | 0.42 | 0.0013 | 0.004 | 0.035 | 0.013 | 0.0004 | 0.0045 | 0.53 | 0.73 | — | — | — | — | 0.00008 |
| 11 | Comparative Example | 0.31 | 0.12 | 0.41 | 0.0009 | 0.004 | 0.034 | 0.012 | 0.0008 | 0.0043 | 0.51 | 0.71 | — | — | — | — | 0.00053 |
| 12 | Comparative Example | 0.29 | 0.28 | 0.42 | 0.0012 | 0.003 | 0.041 | 0.014 | 0.0013 | 0.0041 | 0.98 | 0.69 | — | — | — | — | 0.00092 |
| 13 | Comparative Example | 0.31 | 0.31 | 0.41 | 0.0005 | 0.005 | 0.037 | 0.021 | 0.0019 | 0.0031 | 1.04 | 0.71 | 0.0006 | 0.004 | — | 0.0016 | — |
| 14 | Comparative Example | 0.28 | 0.14 | 0.4 | 0.0005 | 0.005 | 0.038 | 0.015 | 0.0021 | 0.0032 | 0.49 | 0.73 | 0.012 | 0.017 | — | 0.0011 | 0.0011 |
| 15 | Comparative Example | 0.34 | 0.32 | 0.43 | 0.0006 | 0.006 | 0.041 | 0.013 | 0.0005 | 0.0042 | 0.52 | 0.74 | 0.025 | — | 0.06 | 0.0007 | 0.0008 |

The steel of the present invention is desirably produced using a converter, an RH and a continuous casting machine. Gas blowing refining may be performed before or after RH treatment. Since the control accuracy of slag composition is improved thereby, the control accuracy of inclusion morphology can be further enhanced.

When temperature adjustment is performed in RH, a treatment for reacting oxygen with Al and Si in molten steel by adding oxygen gas or solid oxides to the molten steel may be performed. This treatment is preferably performed at an initial stage of RH, since the added oxygen interrupts the control of Mg content by the slag-metal reaction.

EXAMPLES

For confirming the effect on characteristics of the steel for steel tubes of the present invention, the following test was carried out, and the results were evaluated.

1. Test Conditions

After refining a low alloy steel in a converter, composition adjustment and temperature adjustment were performed by RH vacuum treatment. MgO was poured into a ladle during teeming from the converter to adjust the content of MgO in slag to 5 to 10%. Time between the teeming from the converter and the RH treatment was 1 hour.

Steel compositions are as shown in Table 1. Test Nos. 1 to 3 are inventive examples satisfying the limitation of the first inventive steel, Test Nos. 4 to 6 are inventive examples satisfying the limitation of the second inventive steel, and Test For Test Nos. 1 to 6, 10 to 12, 14 and 15, a metal Mg wire was added to molten steel within the ladle after the RH treatment, and a CaSi wire was thereafter further added.

For Test Nos. 7 to 9, CaO and MgO were added during teeming from the converter to control the content of CaO in slag to 55 to 65%, the content of MgO to 8 to 12%, and a total content of Fe oxides and Mn oxides in slag to not more than 1.5%, and then, the content of Al in molten steel at the beginning of RH treatment was controlled to 0.07%. For Test Nos. 7 to 9, Ca of 0.03 kg/ton was solely added to the tundish without adding metal Mg.

The molten steel was processed to yield a round billet 220 to 360 mm in diameter by continuous casting. The following rolling and heat treatment were performed to the cast round billet to evaluate corrosion resistance.

The cast round billet was subjected to piercing and rolling to make a hollow shell, followed by hot rolling and dimensional adjustment with a mandrel mill and a stretch reducer under generally employed conditions, thereby producing seamless steel tubes. Such steel tubes were quenched by heating at 920° C. and then adjusted to a level of yielding strength 758 MPa or more (less than 862 MPa) corresponding to 110 ksi grade and a level of yielding strength 862 MPa or more corresponding to 125 ksi grade by selecting the tempering temperature.

2. Evaluation Conditions for Corrosion Resistance

With respect to steel tubes which were heat-treated and examined for strength and hardness, an evaluation test for SSC resistance was performed.

The evaluation of 110 ksi grade (yielding strength 758 to 862 MPa) was performed for a stress corrosion test specimen comprising 2 mm in thickness, 10 mm in width, and 75 mm in length which was sampled from each steel tube for testing.

A predetermined amount of strain was given to the test specimen by four-point bending according to a method specified in ASTM G39 to apply the stress corresponding to 90% of yield strength of steel to the test specimen. Being immersed in the solution comprising 5% saline water of 25° C. which was saturated with 10 atm hydrogen sulfide, the test specimen was encapsulated in an autoclave together with a testing jig. Five percent saline water was then introduced into the autoclave while leaving plenum to deaerate the solution, hydrogen sulfide gas of a predetermined pressure was then introduced and sealed in the autoclave, and this pressurized hydrogen sulfide gas was saturated to the liquid phase by stirring the liquid phase. After the autoclave was sealed, it was held at 25° C. for 720 hours while stirring the solution at a rate of 100 revolutions per minute, and thereafter depressurized to take out the test specimen.

Determination of cracking was performed by visual observation and, in the case where visual determination is difficult, by embedding the tested test specimen in resin and microscopically observing a cross section thereof.

The evaluation of 125 ksi grade (yielding strength 862 to 965 MPa) was performed to a round bar tensile test piece of 6.35 mm in diameter, which was sampled in parallel to a longitudinal direction of the steel tube.

The stress corresponding to 90% of actual yield strength is continuously applied to the test piece for 720 hours in 2.5% acetic acid+0.41% Na acetate+5% saline solution of 25° C., which was saturated with 0.1 atm hydrogen sulfide gas with the balance carbon dioxide, by a method according to NACE-TM-0177-A-2005, and thereafter checked for fracture.

2. Test Results

With respect to the test pieces subjected to the test in the above-mentioned conditions, evaluation was performed using the inclusion morphology, the total number of inclusions and the fracture rate as evaluation indicators. The test results are shown in Table 2.

TABLE 2

| Test No. | Classification | Inclusion Morphology | Quantity Index | Fracture Rate (110 ksi) | Fracture Rate (125 ksi) |
|---|---|---|---|---|---|
| 1 | Inventive Example | ○ | 1 | 1.3 | 1.6 |
| 2 | Inventive Example | ○ | 0.95 | 0.9 | 1.2 |
| 3 | Inventive Example | ○ | 0.97 | 1.2 | 1.1 |
| 4 | Inventive Example | ○ | 1.02 | 0.3 | 0.2 |
| 5 | Inventive Example | ○ | 0.98 | 0.2 | 0.2 |
| 6 | Inventive Example | ○ | 0.91 | 0.3 | 0.1 |
| 7 | Inventive Example | ○ | 0.85 | 0 | 0 |
| 8 | Inventive Example | ○ | 0.86 | 0 | 0 |
| 9 | Inventive Example | ○ | 0.82 | 0 | 0 |
| 10 | Comparative Example | x | 3.23 | 10.3 | 15.2 |
| 11 | Comparative Example | x | 1.28 | 13.1 | 11.5 |
| 12 | Comparative Example | x | 8.52 | 14.5 | 13.3 |
| 13 | Comparative Example | x | 9.12 | 18.9 | 17.5 |
| 14 | Comparative Example | x | 9.75 | 11.3 | 12.1 |
| 15 | Comparative Example | x | 5.35 | 15.3 | 13.1 |

As the evaluation indicator for corrosion resistance, the fracture rate was used. The fracture rate was calculated, based on the test results, according to the following expression (1) for both the 110 ksi grade and the 125 ksi grade.

$$\text{Fracture Rate}=(\text{The number of fractured test pieces out of all test pieces})/(\text{The total number of test pieces})\times 100 \quad (1)$$

The same test pieces were observed within a visual field of 10 mm×10 mm at a magnification of 1000× by use of a scanning electron microscope to measure the number of inclusions of not less than 1 μm in size. The total of all the number of oxides, oxysulfides and carbonitrides was defined as the total number of inclusions as described above. In Table 2, further, the total number of inclusions was indexed using the total number of inclusions of Test No. 1 as a reference, and organized in terms of quantity index.

As a result of the SEM observation, an inclusion morphology which corresponds to the morphology shown in FIG. 2 described above was shown by ○ and an inclusion morphology other than the morphology shown in the same figure was shown by x in the column of inclusion morphology of Table 2. More specifically, inclusion morphology was investigated using SEM and EDS, where 30 counts of inclusions of not less than 1 μm in size are selected at random and elements analysis for the inclusions was conducted using EDS. According to the EDS elements analysis, the sample in which 15 or more counts of inclusions correspond to the morphology shown in FIG. 2 was evaluated as ○, and the one in which less than 15 counts of inclusions correspond to the morphology shown in FIG. 2 was evaluated as x.

By comparison of the test results of Test Nos. 1, 2 and 3 which satisfy the limitation of the first inventive steel with respect to chemical compositions including Mg content and inclusion morphology, as shown in Table 2, with the test results of Test Nos. 10, 11 and 12 which satisfy none of the limitations of the first inventive steel and the second inventive steel, the number of inclusions was as small as 0.95 to 1 in Test Nos. 1, 2 and 3, compared with 1.28 to 8.52 in Test Nos. 10, 11 and 12. This could confirm that the total number of inclusions can be reduced by satisfying the limitations of the present invention. The fracture rate was also as low as 0.9 to 1.6 in Test Nos. 1, 2 and 3, compared with 10.3 to 15.2 in Test Nos. 10, 11 and 12.

By comparison of the test results of Test Nos. 4, 5 and 6 which satisfy the limitation of the second inventive steel with the test results of Test Nos. 13, 14 and 15 which satisfy none of the limitations of the first inventive steel and the second inventive steel, the fracture rate in Test Nos. 13, 14 and 15 was 11.3 to 18.9%, which was two digit larger than 0.1 to 0.3% of the fracture rate in Test Nos. 4, 5 and 6.

Further, Test Nos. 4, 5 and 6 were found to be excellent in corrosion resistance, with the fracture rate reduced to 0.1 to 0.3 by the addition of alloy elements, compared with Test Nos. 1, 2 and 3 with less alloy elements.

Moreover, among the inventive examples, Test Nos. 7, 8 and 9 in which the molten steel treatment method was optimized were further reduced in the number of inclusions, compared with Test Nos. 1 to 6, and the fracture rate therein was 0. Thus, by actively controlling the steel compositions and the inclusions, the effects of the steel of the present invention can be stabilized at high level.

As described above, the number of inclusions can be reduced by satisfying the limitation of the first inventive steel, and the corrosion resistance of steel product can be improved by satisfying the limitation of the second inventive steel.

INDUSTRIAL APPLICABILITY

The steel for steel tubes of the present invention is excellent in cleanliness with fewer harmful coarse inclusions, and usable as a steel material for steel tubes, and casings, tubing, excavating drill pipes, drill collars, etc. for oil well or natural gas well, and can simultaneously improve various characteristics thereof. This steel is also easy to be produced and controlled.

REFERENCE SIGNS LIST

1: Mg—Al—O-based oxides
2*a*: Ca—Al-based oxides
2*b*: Ca—Al-based oxysulfides
3: Ti-containing-carbonitrides or -carbides

What is claimed is:

1. A steel for steel tubes with excellent sulfide stress cracking resistance which comprises, by mass %:

C: 0.2 to 0.7%;
Si: 0.01 to 0.8%;
Mn: 0.1 to 1.5%;
S: not more than 0.005%;
P: not more than 0.03%;
Al: 0.0005 to 0.1%;
Ti: 0.005 to 0.05%;
Ca: 0.0004 to 0.005%;
N: not more than 0.007%;
Cr: 0.1 to 1.5%; and
Mo: 0.2 to 1.0%;
O: up to 0.0015%;
optionally Nb: 0.005 to 0.1%;
the balance being Fe, Mg and impurities,
wherein the content of Mg in the steel is not less than 1.0 ppm and not more than 5.0 ppm;
and wherein non-metallic inclusions of not less than 50% of the total number of those in steel each having the maximum bulk size of not less than 1 μm and comprising two or more elements of Ca, Al, Mg, Ti and Nb and two or more elements of O, S and N have such a morphology that Mg—Al—O-based oxides exist at the central part of the inclusion, Ca—Al-based oxides and/or Ca—Al-based oxysulfides enclose the Mg—Al—O-based oxides, and Ti-containing-carbonitrides or -carbides further exist on a complete or partial periphery of the Ca—Al-based oxides and/or Ca—Al-based oxysulfides.

2. A steel for steel tubes with excellent sulfide stress cracking resistance which comprises, by mass %:

C: 0.2 to 0.7%;
Si: 0.01 to 0.8%;
Mn: 0.1 to 1.5%;
S: not more than 0.005%;
P: not more than 0.03%;
Al: 0.0005 to 0.1%;
Ti: 0.005 to 0.05%;
Ca: 0.0004 to 0.005%;
N: not more than 0.007%;
Cr: 0.1 to 1.5%;
Mo: 0.2 to 1.0%; and
O: up to 0.0015%;
one or more of Nb: 0.005 to 0.1%, Zr: 0.005 to 0.1%, V: 0.005 to 0.5% and B: 0.0003 to 0.005%;
the balance being Fe, Mg and impurities,
wherein the content of Mg in the steel is not less than 1.0 ppm and not more than 5.0 ppm;
and wherein non-metallic inclusions of not less than 50% of the total number of those in steel each having the maximum bulk size of not less than 1 μm and comprising two or more elements of Ca, Al, Mg, Ti and Nb and two or more elements of O, S and N have such a morphology that Mg—Al—O-based oxides exist at the central part of the inclusion, Ca—Al-based oxides and/or Ca—Al-based oxysulfides enclose the Mg—Al—O-based oxides, and Ti-containing-carbonitrides or -carbides further exist on a complete or partial periphery of the Ca—Al-based oxides and/or Ca—Al-based oxysulfides.

* * * * *